US006049914A

United States Patent [19]

Heilman

[11] Patent Number: 6,049,914

[45] Date of Patent: Apr. 18, 2000

[54] MAGNETIC ARTICLES OF CLOTHING

[76] Inventor: Lawrence A. Heilman, 151 Mountville Dr., Lebanon, Pa. 17046

[21] Appl. No.: 09/036,429

[22] Filed: Mar. 5, 1998

[51] Int. Cl.[7] ..... A41B 13/10; A41D 27/20

[52] U.S. Cl. ..... 2/247; 2/48

[58] Field of Search ..... 2/48, 49.2, 247

[56] References Cited

U.S. PATENT DOCUMENTS 3,724,101 4/1973 Slezak .
3,886,508 5/1975 Lavrard .
4,710,979 12/1987 Bull et al. .
4,826,059 5/1989 Bosch et al. .
5,103,501 4/1992 Meisels .
5,107,545 4/1992 Potter .
5,450,858 9/1995 Zablotsky et al. .
5,604,960 2/1997 Good .
5,720,046 2/1998 Lopez et al. .
5,740,557 4/1998 Reid et al. .

*Primary Examiner*—John J. Calvert
*Assistant Examiner*—Shirra L. Jenkins

[57] ABSTRACT

A magnetic outfit system is provided including an article of clothing and a magnet situated within the article of clothing for allowing the selective securement of metallic construction and household items thereto.

8 Claims, 4 Drawing Sheets

MAGNETIC ARTICLES OF CLOTHING

BACKGROUND OF THE INVENTION

1. Field of the Invention

The present invention relates to magnetic coupling devices and more particularly pertains to new magnetic articles of clothing for carrying tools and other construction or household entities on an exterior of various articles of clothing for easy access.

2. Description of the Prior Art

The use of magnetic coupling devices is known in the prior art. More specifically, magnetic coupling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art magnetic coupling devices include U.S. Pat. No. 5,369,899; U.S. Pat. No. 5,328,411; U.S. Pat. No. 4,993,245; U.S. Pat. No. 5,341,975; U.S. Pat. No. 5,072,456; and U.S. Patent Des. 360,517.

In these respects, the magnetic articles of clothing according to the present invention substantially depart from the conventional concepts and designs of the prior art, and in so doing provides an apparatus primarily developed for the purpose of carrying tools and other construction entities on an exterior of various articles of clothing.

SUMMARY OF THE INVENTION

In view of the foregoing disadvantages inherent in the known types of magnetic coupling devices now present in the prior art, the present invention provides new magnetic articles of clothing construction wherein the same can be utilized for carrying tools and other construction entities on an exterior of various articles of clothing.

The general purpose of the present invention, which will be described subsequently in greater detail, is to provide new magnetic articles of clothing apparatus and method which have many of the advantages of the magnetic coupling devices mentioned heretofore and many novel features that result in new magnetic articles of clothing which are not anticipated, rendered obvious, suggested, or even implied by any of the prior art magnetic coupling devices, either alone or in any combination thereof.

To attain this, the present invention generally comprises a pair of pants having a pair of front and rear pockets each situated therein. As shown in FIGS. 6 & 7, the present invention further includes a work apron removably attachable to a waist of the user. During use, the work apron depends downwardly in front of the pants of the user. The work apron is equipped with a plurality of pockets formed therein with a top opening for allowing access thereto. At least one front pocket magnet plate has a smooth inner and outer surface with a periphery formed therebetween. As shown in FIG. 3, the periphery is formed of a linear top edge, a linear rear edge, and an arcuate front and bottom edge defining a portion of a circle. The front pocket magnet plate is removably situated within one of the front pockets. At least one rear pocket magnet plate has a smooth inner and outer surface with a periphery formed therebetween. The periphery is formed of a linear top edge, a pair of linear side edges, and an arcuate bottom edge defining a portion of a circle. The rear pocket magnet plate is removably situated within one of the rear pockets. Finally, at least one apron magnet plate has a smooth inner and outer surface with a rectangular periphery formed therebetween. The apron magnet plate is removably situated within one of the pockets of the apron.

There has thus been outlined. rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new magnetic articles of clothing apparatus and method which have many of the advantages of the magnetic coupling devices mentioned heretofore and many novel features that result in new magnetic articles of clothing which are not anticipated, rendered obvious, suggested, or even implied by any of the prior art magnetic coupling devices, either alone or in any combination thereof.

It is another object of the present invention to provide new magnetic articles of clothing which may be easily and efficiently manufactured and marketed.

It is a further object of the present invention to provide new magnetic articles of clothing which are of a durable and reliable construction.

An even further object of the present invention is to provide new magnetic articles of clothing which are susceptible of a low cost of manufacture with regard to both materials and labor, and which accordingly is then susceptible of low prices of sale to the consuming public, thereby making such magnetic articles of clothing economically available to the buying public.

Still yet another object of the present invention is to provide magnetic articles of clothing which provide in the apparatuses and methods of the prior art some of the advantages thereof, while simultaneously overcoming some of the disadvantages normally associated therewith.

Still another object of the present invention is to provide new magnetic articles of clothing for carrying tools and other construction entities on an exterior of various articles of clothing.

Even still another object of the present invention is to provide new magnetic articles of clothing that include an article of clothing and a magnet situated within the article of clothing for allowing the selective securement of metallic construction and household items thereto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
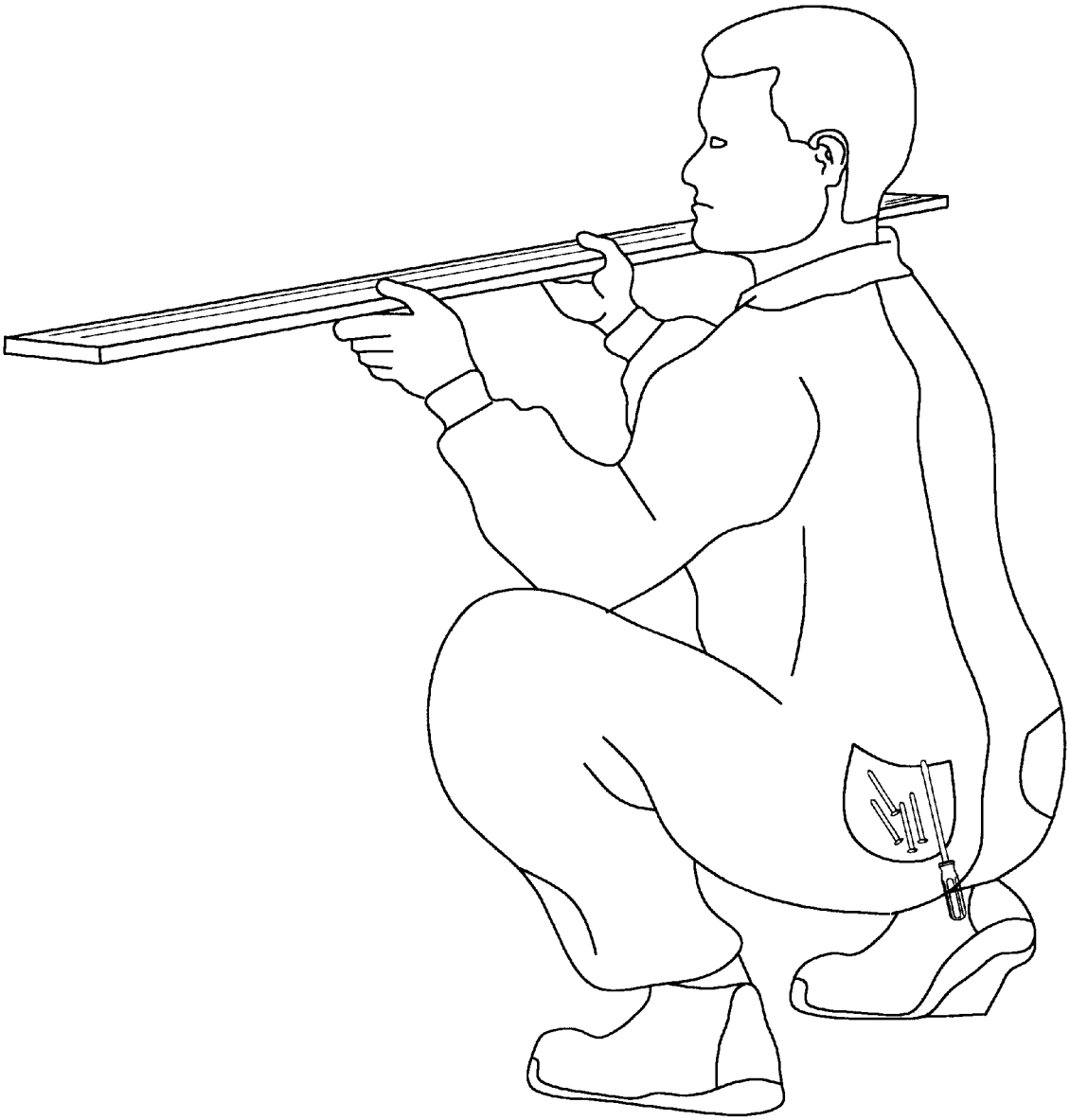
FIG. 1 is a perspective view of new magnetic articles of clothing according to the present invention.
Figure 2:
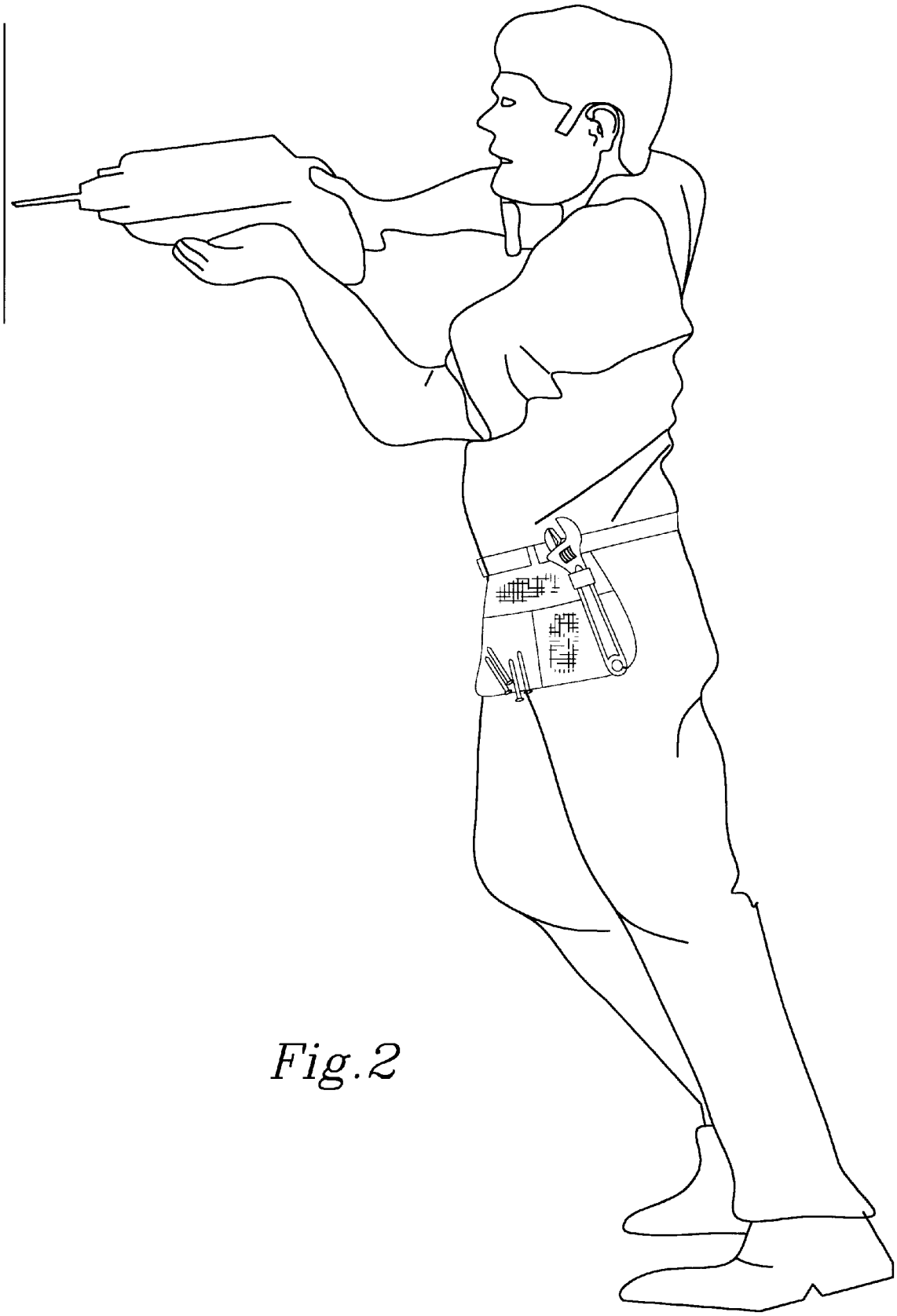
FIG. 2 is another perspective view of the present invention during use.

With reference now to the drawings, and in particular to FIGS. 1 through 8 thereof, new magnetic articles of clothing embodying the principles and concepts of the present invention and generally designated by the reference numeral 10 will be described.

The present invention, as designated as numeral 10, includes a pair of pants 12 having a pair of front and rear pockets 14 each situated therein. Each of such pockets has an upper peripheral edge stitchedly mounted to a periphery of a slot 16 formed in a front and rear extent of the pants adjacent to a waist thereof.

Figure 6:
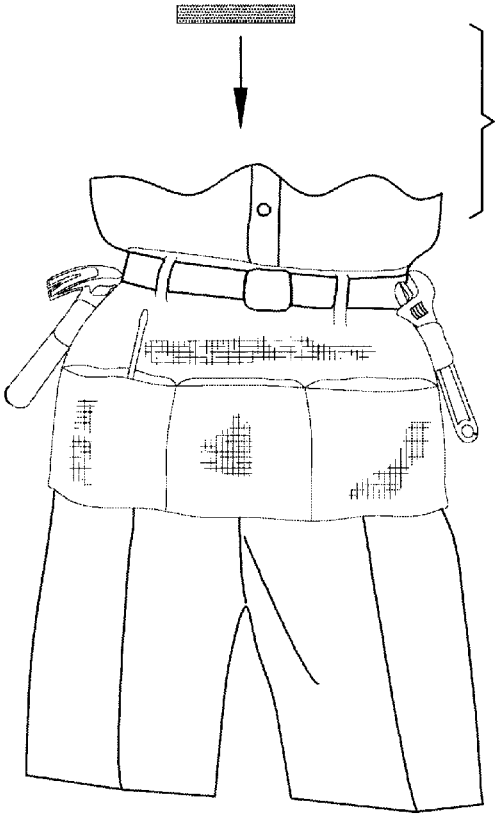
FIG. 6 is a front view of the apron magnet plate of the present invention.
Figure 7:
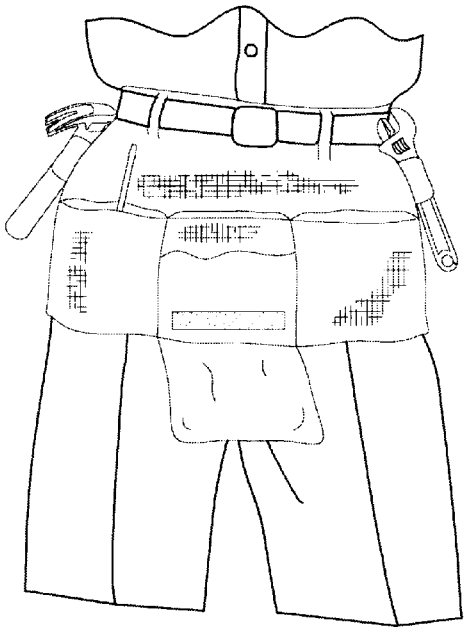
FIG. 7 is another front view of the apron magnet plate of the present invention shown within the associated pocket.
Figure 8:
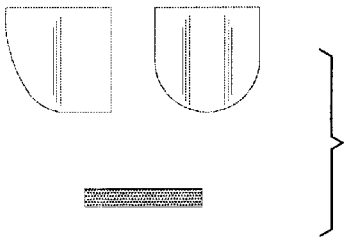
FIG. 8 is a perspective view of all of the magnets of the present invention.

As shown in FIGS. 6 & 7, the present invention further includes a work apron 18 removably attachable to a waist of the user. During use, the work apron depends downwardly in front of the pants of the user. The work apron is equipped with a plurality of pockets 20 formed therein with a top opening for allowing access thereto.

Figure 3:
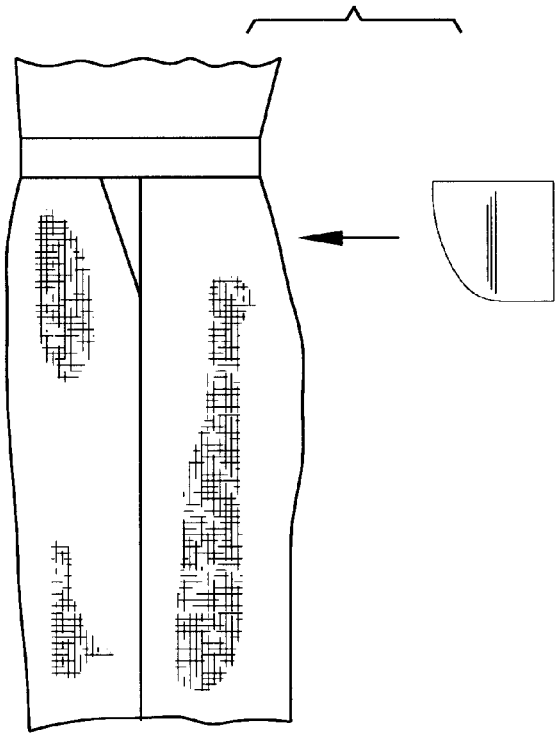
FIG. 3 is a side view of the front pocket magnet plate of the present invention.
Figure 4:
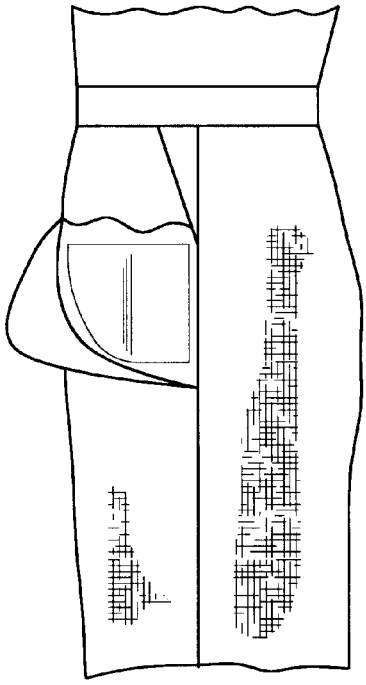
FIG. 4 is another side view of the front pocket magnet plate of the present invention.
Figure 5:
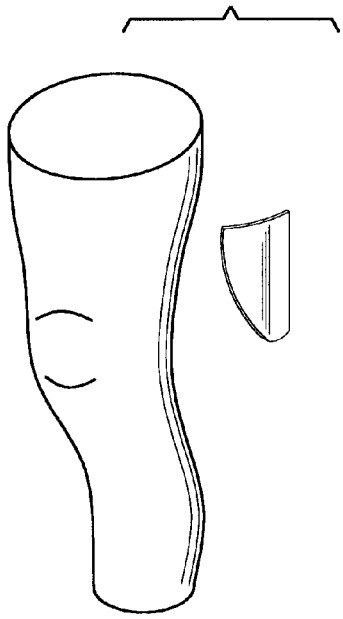
FIG. 5 is a perspective view of the front pocket magnet plate of the present invention shown in comparison with a leg of a user.

At least one front pocket magnet plate 22 has a smooth inner and outer surface with a periphery formed therebetween. As shown in FIG. 3, the periphery is formed of a linear top edge, a linear rear edge, and an arcuate front and bottom edge together defining a portion of a circle. In the preferred embodiment, the front magnetic plate is bent such that it defines a portion of a vertically oriented cylinder. Note FIG. 5. The arcuate nature of the bottom edge and front edge prevent chaffing of the legs of the user. During use, the front pocket magnet plate is removably situated within one of the front pockets.

At least one rear pocket magnet plate 24 has a smooth inner and outer surface with a periphery formed therebetween. The periphery is formed of a linear top edge, a pair of linear side edges, and an arcuate bottom edge defining a portion of a circle. The rear pocket magnet plate is removably situated within one of the rear pockets. Similar to the front magnetic plate, the present plate is bent such that it defines a portion of a vertically oriented cylinder. It should be noted that depending on the weight of the tools which are carried by the pocket magnets, the same arc preferably constructed with a certain degree of flexibility for precluding discomfort to the user.

Finally, at least one apron magnet plate 26 has a smooth inner and outer surface with an elongated rectangular periphery formed therebetween. The apron magnet plate is removably situated within one of the pockets of the apron. As shown, the apron magnet plate preferably is situated adjacent to a bottom edge of the pocket. As an option, each of the magnets of the present invention may be lined with an elastomeric material for precluding discomfort to the user.

In an alternate embodiment, the magnet plates each may be mounted within a pouch fixed to an inner surface of the pants between the pants and one of the corresponding pockets thereby constituting an integral portion of the article of clothing. In further alternate embodiments, the magnet plates may be stitchedly coupled within the corresponding pocket of the article of clothing. It should be noted that during use, the magnet plates also preclude the inadvertent removal of items situated within the pocket.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A construction outfit system comprising, in combination:

a pair of pants having a pair of front pockets each situated within the pants, the pair of pants further including a pair of rear pockets each situated within the pants;

a work apron removably attachable to a waist of the user and depending downwardly in front of the pants of the user, the work apron having a plurality of pockets formed therein with a top opening for allowing access thereto;

at least one front pocket magnet plate having a smooth inner and outer surface with a periphery formed therebetween, the periphery formed of a linear top edge, a linear rear edge, and an arcuate front and bottom edge defining a portion of a circle, the front pocket magnet plate removably situated within at least one of the front pockets;

at least one rear pocket magnet plate having a smooth inner and outer surface with a periphery formed therebetween, the periphery formed of a linear top edge, a pair of linear side edges, and an arcuate bottom edge defining a portion of a circle, the rear pocket magnet plate removably situated within one of the rear pockets; and at least one apron magnet plate having a smooth inner and outer surface with a rectangular periphery formed therebetween, the apron magnet plate removably situated within one of the pockets of the apron.

2. A magnetic outfit system comprising:

a pair of pants having a front pocket;

an apron having at least one pocket;

a front pocket magnet positionable in the front pocket of the pair of pants for allowing the selective securement of metallic construction and household items thereto;

an apron magnet positionable in the pocket of the apron for allowing the selective securement of metallic construction and household items thereto;

wherein the front pocket magnet is removably situated within the front pocket formed in the pair of pants, the front pocket in the pair of pants having at least one open side for providing an opening into an interior of the front pocket in the pair of pants for selective insertion and removal of the front pocket magnet; and wherein the apron magnet is removably situated within the pocket formed in the apron, the pocket in the apron having at least one open side for providing an opening into an interior of the pocket in the apron for selective insertion and removal of the apron magnet.

3. A magnetic outfit system as set forth in claim 2 wherein the front pocket magnet has at least one arcuate edge to prevent chaffing of a wearer of the pair of pants and for facilitating insertion of the front pocket magnet into the front pocket in the pair of pants through the opening into the front pocket in the pair of pants.

4. A magnetic outfit system as set forth in claim 2 wherein the front pocket magnet has a smooth thin configuration.

5. A magnetic outfit system as set forth in claim 2 wherein the apron magnet has at least one arcuate edge to prevent chaffing of a wearer of the apron and for facilitating insertion of the apron magnet into the pocket in the apron through the opening into the pocket in the apron.

6. A magnetic outfit system as set forth in claim 2 wherein the apron magnet has a smooth thin configuration.

7. A magnetic outfit system as set forth in claim 2, further comprising:

at least one rear pocket in the pair of pants;

a rear pocket magnet positionable in the rear pocket of the pair of pants for allowing the selective securement of metallic construction and household items thereto; and wherein the rear pocket magnet is removably situated within the rear pocket formed in the pair of pants, the rear pocket in the pair of pants having at least one open side for providing an opening into an interior of the rear pocket in the pair of pants for selective insertion and removal of the rear pocket magnet.

8. A magnetic outfit system as set forth in claim 7 wherein the rear pocket magnet has a smooth thin configuration.

* * * * *